US010244790B1

(12) United States Patent
Christie

(10) Patent No.: US 10,244,790 B1
(45) Date of Patent: Apr. 2, 2019

(54) CIGARETTE HOLDER WITH A MOUTHPIECE

(71) Applicant: Coneway Christie, Loganville, GA (US)

(72) Inventor: Coneway Christie, Loganville, GA (US)

( * ) Notice: Subject to any disclaimer, the term of this patent is extended or adjusted under 35 U.S.C. 154(b) by 912 days.

(21) Appl. No.: 14/810,645

(22) Filed: Jul. 28, 2015

(51) Int. Cl.
*A24F 13/12* (2006.01)
*A24F 13/22* (2006.01)
*A24F 7/00* (2006.01)

(52) U.S. Cl.
CPC ..... *A24F 13/22* (2013.01); *A24F 7/00* (2013.01)

(58) Field of Classification Search
CPC ..... A24F 16/16; A24F 13/14; A24F 13/02; A24F 13/04; A24F 13/06; A24F 13/08
See application file for complete search history.

(56) References Cited

U.S. PATENT DOCUMENTS

| | | | | |
|---|---|---|---|---|
| 1,554,353 | A | 9/1925 | Johnson | |
| 2,070,831 | A | 2/1937 | Grundon | |
| 2,738,792 | A | 3/1956 | Smith | |
| 2,768,630 | A | 10/1956 | Johnson | |
| 3,100,493 | A | 8/1963 | Rundle | |
| 3,155,099 | A | 11/1964 | Minchin | |
| 4,289,149 | A | 9/1981 | Kyriakou | |
| 4,532,942 | A * | 8/1985 | Aikman | A24D 3/045 131/198.1 |
| D292,324 | S | 10/1987 | Decker | |
| 2005/0166931 | A1 | 8/2005 | Hcu | |
| 2013/0167850 | A1 | 7/2013 | Al-Aawar | |

FOREIGN PATENT DOCUMENTS

| | | |
|---|---|---|
| CN | 202154026 | 3/2012 |

* cited by examiner

*Primary Examiner* — Michael H. Wilson
*Assistant Examiner* — Dionne W. Mayes

(57) ABSTRACT

The cigarette holder with a mouthpiece is an accessory used with smoking material. The smoking material is inserted into a chamber cylinder of the cigarette holder with a mouthpiece and the smoke is inhaled through a mouthpiece. The cigarette holder with a mouthpiece comprises a mouthpiece and a plurality of chambers. Alternate embodiments of the disclosure further comprise a plurality of extensions and a plurality of tips.

17 Claims, 7 Drawing Sheets

CIGARETTE HOLDER WITH A MOUTHPIECE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of cigarette holders and cigarette holder design, more specifically, a modular cigarette holder.

SUMMARY OF INVENTION

The cigarette holder with a mouthpiece is an accessory used with smoking material that is used to: 1) keep debris from the smoking material out of the smoker's mouth; 2) cool the inhaled smoke; 3) keep smoke, other than inhaled smoke, out of the face of the smoker; and, 4) to contain a mesh filter. The smoking material is inserted into a chamber cylinder of the cigarette holder with a mouthpiece and the smoke is inhaled through a mouthpiece.

These together with additional objects, features and advantages of the cigarette holder with a mouthpiece will be readily apparent to those of ordinary skill in the art upon reading the following detailed description of the presently preferred, but nonetheless illustrative, embodiments when taken in conjunction with the accompanying drawings.

In this respect, before explaining the current embodiments of the cigarette holder with a mouthpiece in detail, it is to be understood that the cigarette holder with a mouthpiece is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the cigarette holder with a mouthpiece.

It is therefore important that the claims be regarded as including such equivalent construction insofar as they do not depart from the spirit and scope of the cigarette holder with a mouthpiece. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
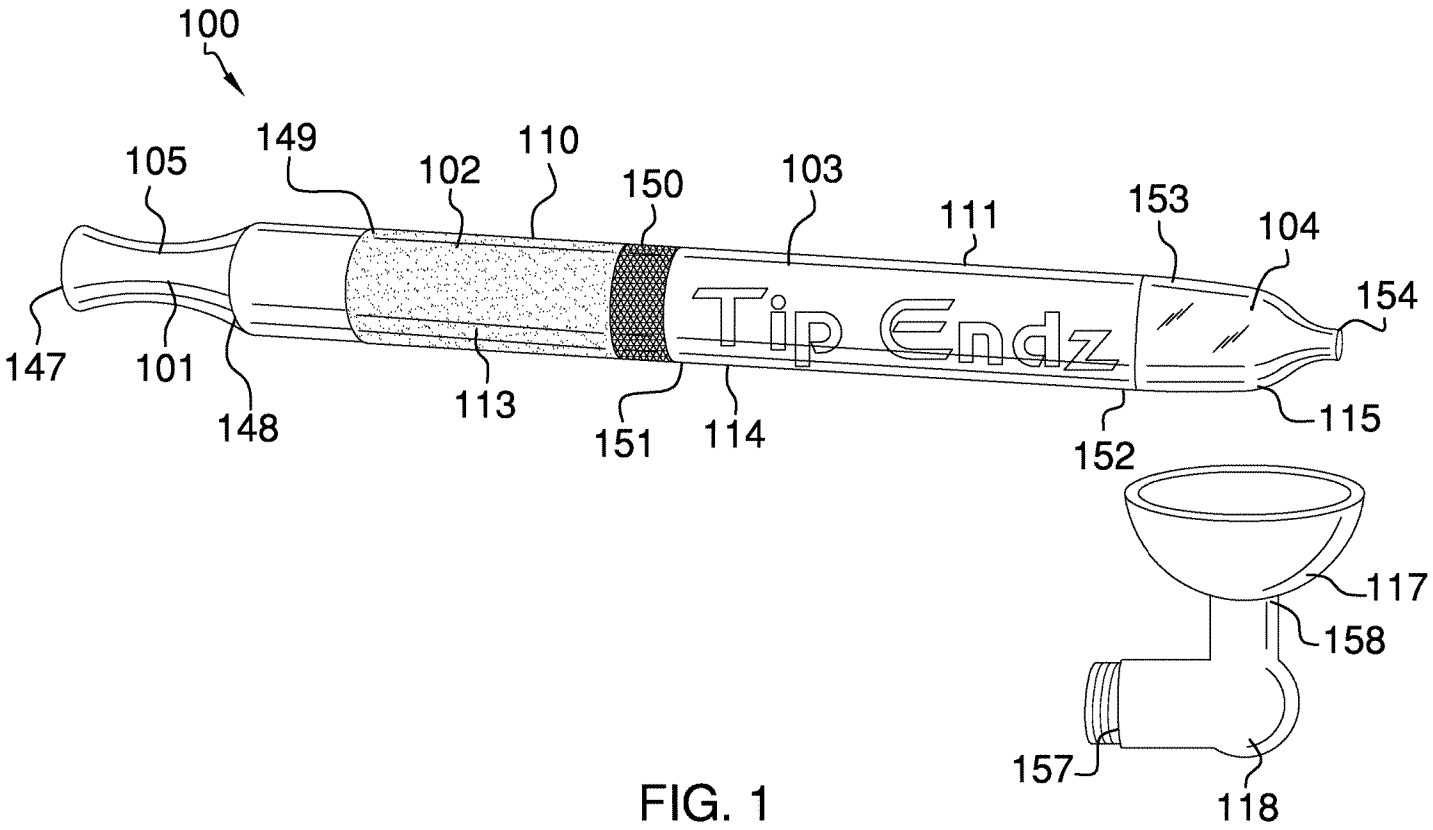
FIG. 1 is a perspective view of an embodiment of the disclosure.
Figure 2:
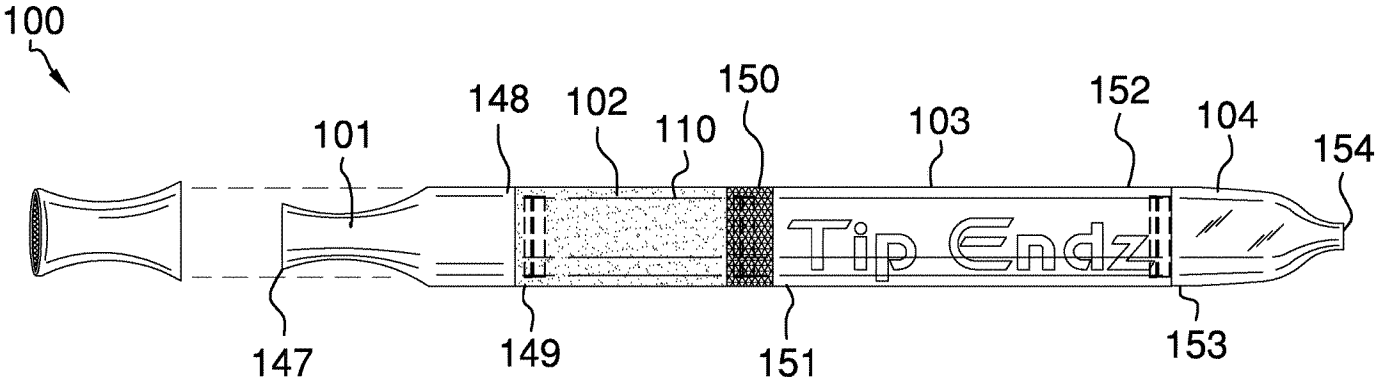
FIG. 2 is a side view of an embodiment of the disclosure.
Figure 3:
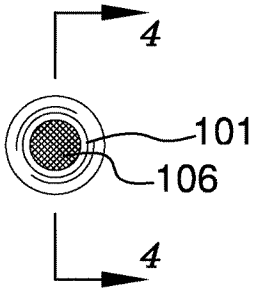
FIG. 3 is an end view of an embodiment of the disclosure.
Figure 4:
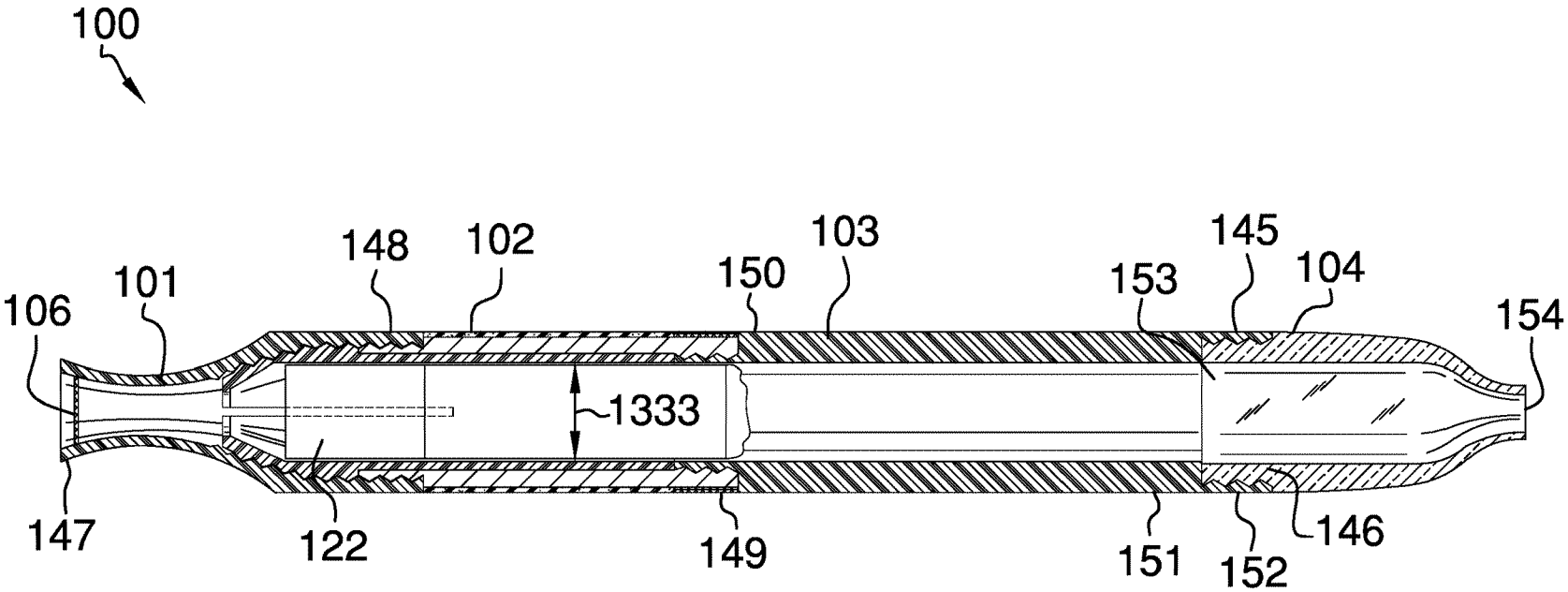
FIG. 4 is a cross-sectional view of an embodiment of the disclosure.
Figure 5:
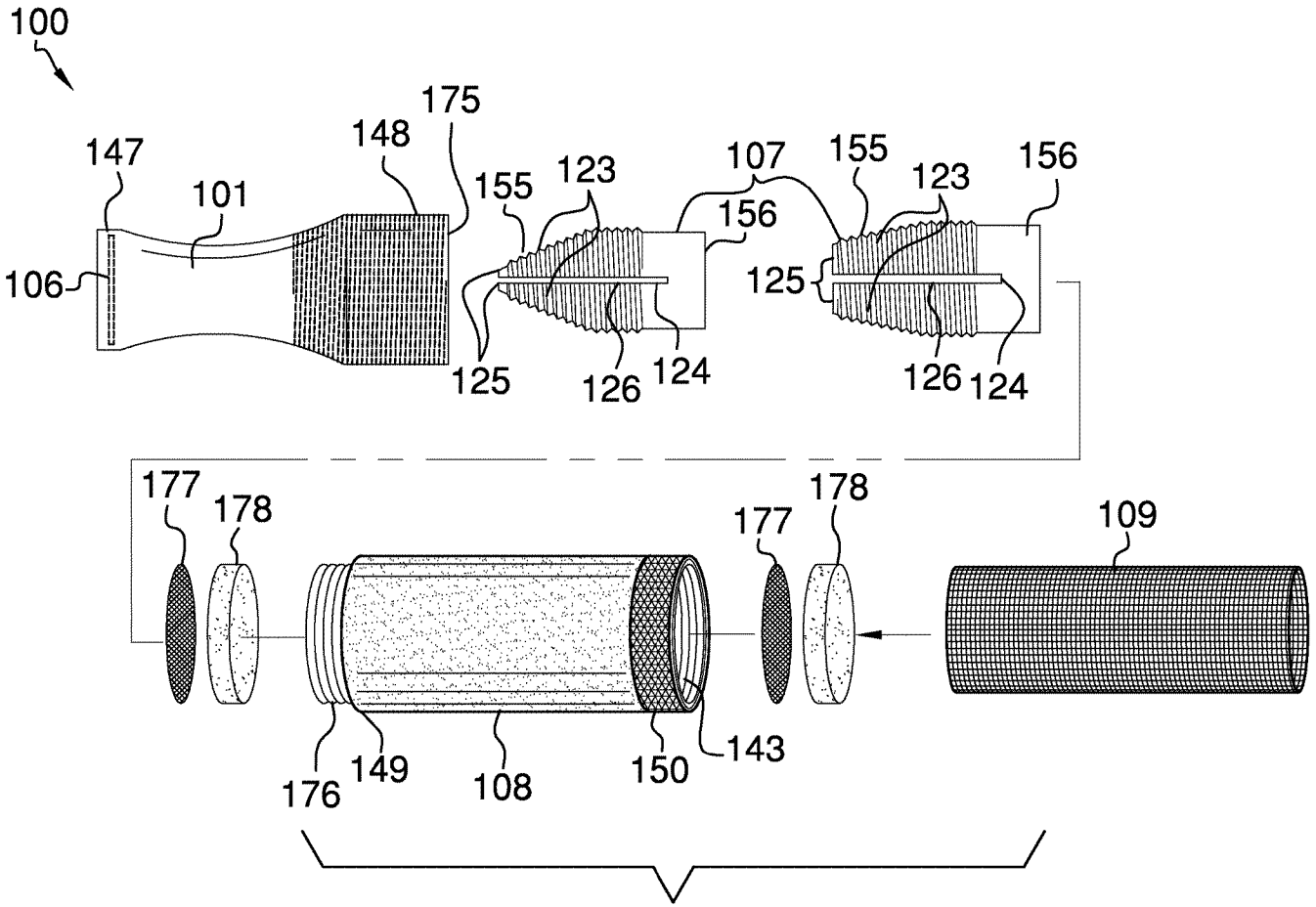
FIG. 5 is an exploded view of an embodiment of the disclosure.
Figure 6:
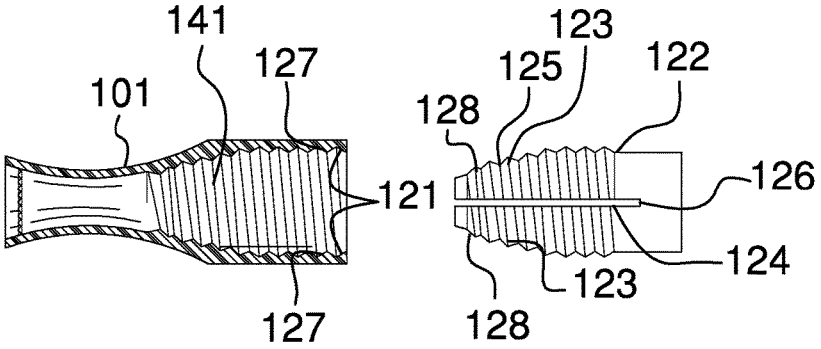
FIG. 6 is a detail view of an embodiment of the disclosure.
Figure 7:
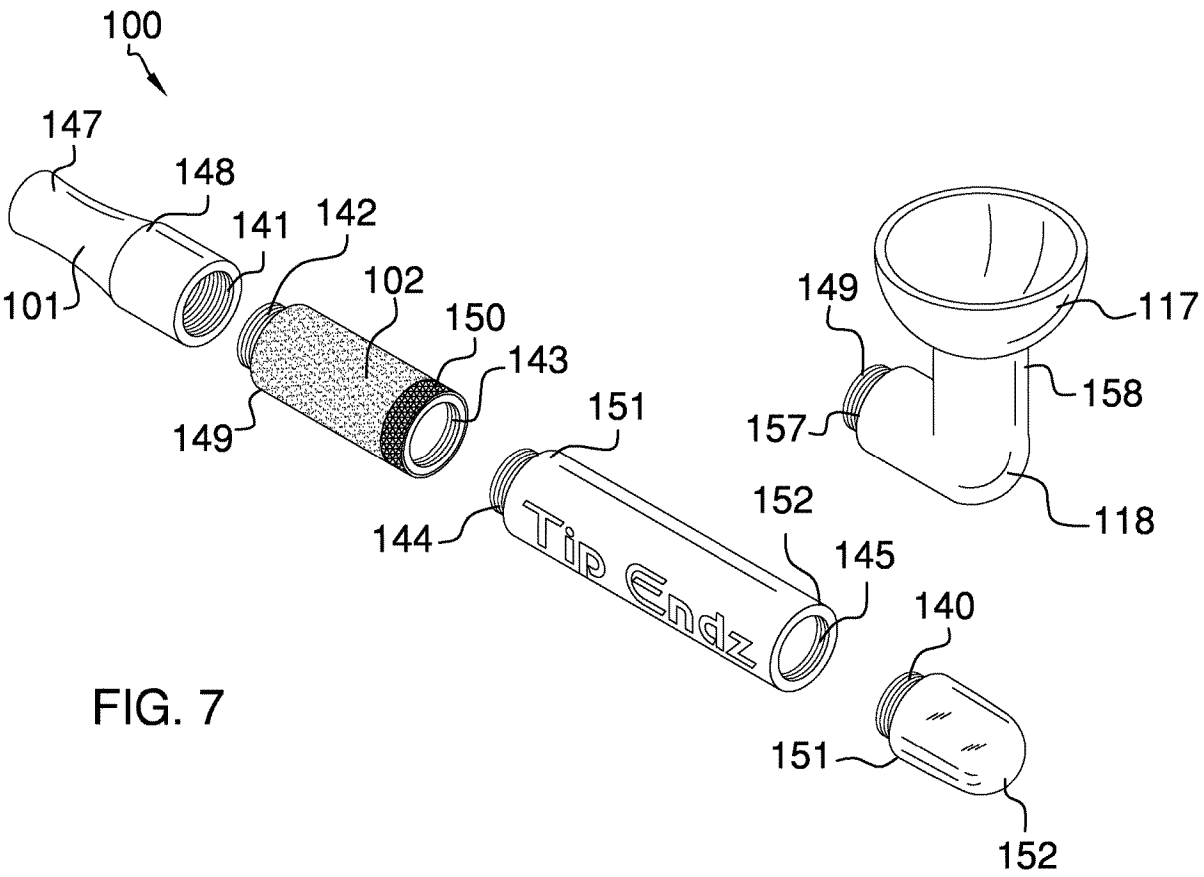
FIG. 7 is an alternate exploded view of an embodiment of the disclosure.
Figure 8:
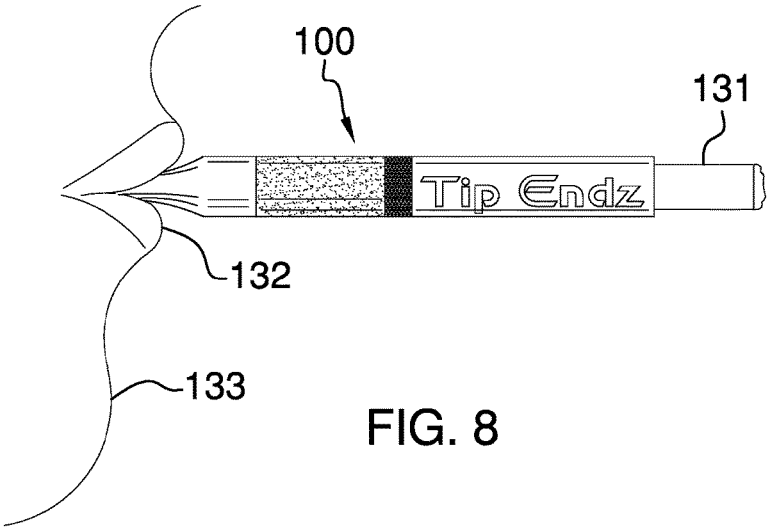
FIG. 8 is an in use view of an embodiment of the disclosure.

Detailed reference will now be made to a first potential embodiment of the disclosure, which is illustrated in FIGS. 1 through 8. The cigarette holder with a mouthpiece 100 (herein after invention) comprises a mouthpiece 101 and a plurality of chambers 102. The mouthpiece 101 is adapted to be placed in the mouth 132 so that when the user 133 inhales smoke from the smoking material 131 enters the mouth 132. Each of the plurality of chambers 102 is adapted to receive the smoking materials 131 that will be consumed. Each of the chambers in the plurality of chambers 102 is differentiated from the remaining chambers in the plurality of chambers 102 by span of the inner diameter 1333 of the chamber cylinder 108. This is explained in more detail elsewhere in this disclosure. The purpose of the variation of sizes among the plurality of chambers 102 is to accommodate smoking materials 131 of different sizes.

The mouthpiece 101 further comprises a mouthpiece cylinder 105, a screen 106, and a chamber connection 107. The mouthpiece 101 is further defined with a seventh end 147 and an eighth end 148. The mouthpiece 101 is formed in the shape of a tube. The seventh end 147 of the tube tapers away from the centerline of the tube. The eighth end 148 of the tube tapers away from the center line of the tube. The screen 106 is a cloth or wire mesh that is mounted inside seventh end 147 of the mouthpiece 101. The purpose of the screen 106 is to filter out ashes and debris that may carried along with the smoke before they enter the mouth 132.

The purpose of the chamber connection 107 is to attach the mouthpiece 101 to a chamber selected from the plurality of chambers 102. The chamber connection 107 is attached to eighth end 148 of the mouthpiece 101. The chamber connection 107 has two potential embodiments of the disclosure.

The first potential embodiment of the disclosure calls for a ratchet rim 121. The ratchet rim 121 is a ridge that is formed inside the eighth end 148. The ratchet rim 121 gradually decreases the inner diameter of the mouthpiece 101 as the ratchet rim 121 moves from the eighth edge 148 towards the seventh edge 147. Where the ratchet rim 121 ends, the ratchet rim 121 forms a catch surface 127 that runs perpendicular to the centerline of the mouthpiece 101. This catch surface 127 is designed to catch a plurality of latch hooks 123 from a chamber plug 122, which is used to connect a chamber selected from the plurality of chambers 102 to the mouthpiece 101. The chamber plug 122 is discussed in more detail elsewhere in this disclosure.

The second potential embodiment of the disclosure calls for a first interior screw thread 141. The first interior screw thread 141 is formed inside the eighth end 148 of the mouthpiece 101. The first interior screw thread 141 is sized to receive a second exterior screw thread 142 that is formed on the face of the ninth end 149 of the individual chamber 113 selected from the plurality of chambers 102. The plurality of chambers 102 is discussed in greater detail elsewhere in this disclosure.

The plurality of chambers 102 comprises a collection of individual chambers 113. Each individual chamber 113 further comprises a chamber cylinder 108, an optional mesh filter 109 and a grip 110. The chamber cylinder 108 is further defined with a ninth end 149 and a tenth end 150. The chamber cylinder 108 is formed in the shape of a tube. The grip 110 is a layer of heat resistant material that is applied to a portion of the face of the chamber cylinder 108. The grip 110 is used to improve the security of the hold the user has on the invention 100. The optional mesh filter 109 is a porous device that is used to remove large particles from the smoke stream. When used, the optional mesh filter 109 is inserted in the ninth end 149 of the chamber cylinder 108.

A third interior screw thread 143 is formed inside the tenth end 150 of the chamber cylinder 108. A secondary screen 177 and a secondary filter 178 may be provided at the tenth end 150 as well as the ninth end 149 of the chamber cylinder 108. Moreover, the optional mesh filter 109 is sandwiched between the secondary screen 177 and the secondary filter 178 that are provided at the tenth end 150 as well as the ninth end 149 of the chamber cylinder.

In the first potential embodiment of the disclosure, the each individual chamber 113 further comprises a chamber plug 122. The chamber plug 122 is a tube. The chamber plug 122 is further defined with a fifteenth end 155 and a sixteenth end 156. The chamber plug 122 further comprises a plurality of latch hooks 123 and a plurality of compression channels 124. The plurality of latch hooks 123 comprises a collection of individual latch hooks 125. The plurality of compression channels 124 comprises a collection of individual compression channels 126.

The individual latch hook 125 is an angled surface 128 that is formed on the fifteenth end 155 of the chamber plug 122. The angled surface 128 flares away from the centerline of the chamber plug 122. The plurality of compression channels 124 comprises a collection of individual compression channels 126. Each individual compression channel 126 is a channel formed through the face of the chamber plug 122. The purpose of the plurality of compression channels 124 is to allow the chamber plug 122 to compress when the angled surfaces 128 press against the ratchet rim 121. Similarly the plurality of compression channels 124 allow the chamber plug 122 to compress when the face of the chamber plug 122 is squeezed. The outer diameter of the chamber plug 122 at the sixteenth end 156 is sized to fit within the inner diameter of the ninth end 149 of the chamber cylinder 108. If necessary, the outer diameter of the fifteenth end 155 can be flared down relative to the outer diameter of the sixteenth end 156 so that the fifteenth end 155 of the chamber plug 122 will fit into the eighth end 148 of the mouthpiece 101. Depending on the selected mix within the plurality of chambers 102, multiple chamber plugs 122 may or may not need to be supplied with the invention 100.

To connect the mouthpiece 101 to an individual chamber 113 in the first potential embodiment of the disclosure, the fifteenth end 155 of the chamber plug 122 is inserted into the mouthpiece 101 so that the angled surface 128 of each of the plurality of latch hooks 123 extends beyond the ratchet ridge 121. This releases the compression force on the individual latch hooks 125 and allows the ratchet rim 121 to lock plurality of latch hooks 123 in place after the plurality of latch hooks 123 have returned to their original position. The ninth end 149 of the chamber cylinder 108 is then placed over the sixteenth end 156 of the chamber plug 122.

The ninth end 149 may include external threading 176 that correspond with the first interior screw thread 141 of the eighth end 148 of the mouthpiece 101. The individual latch hook 125 may also be external threadings that correspond with the first interior screw thread 141 of the eighth end 148 of the mouthpiece 101 such that the chamber plug 122 threads into the mouthpiece 101 before the chamber cylinder 108 is screwed onto the mouthpiece 101 (see FIGS. 4 and 5).

In the second potential embodiment of the disclosure, each individual chamber 113 further comprises a second exterior screw thread 142. The second exterior screw thread 142 is formed at the ninth end 149 of the face of the chamber cylinder 108. The second exterior screw thread 142 is sized to be received by the first interior screw thread 141. In the second potential embodiment of the disclosure, the ninth end 149 of the individual chamber 113 may need to be tapered towards the centerline of the individual chamber 113 to accommodate the first interior screw thread 141 receiving the second exterior screw thread 142 when the individual chamber 113 is intended to receive a large amount of smoking material 131.

In a third potential embodiment of the disclosure, the invention 100 as described both in the first potential embodiment of the disclosure and the second potential embodiment of the disclosure further comprises a plurality of extensions 103. The plurality of extensions 103 further comprises a collection of individual extensions 114. Each of the plurality of extensions 103 is matched to one of the plurality of the chambers 102 such that each of the plurality of extensions 103 is designed to attach to one of the plurality of chambers 102. The purpose of each of the plurality of extensions 103 is to hold the smoking material 131 at a greater distance from the face of the user then each of the plurality of chambers 102 can provide. Each individual extension 114 is further defined with an eleventh end 151 and a twelfth end 152. Each of the individual extensions 114 is a tube. The eleventh end 151 of the individual extension 114 is fitted with a fourth exterior screw thread 144. The fourth exterior screw thread 144 is sized to be received by the third interior screw thread 143. The individual extension 114 is attached to the chamber by screwing the fourth exterior screw thread 144 into the third interior screw thread 143. The twelfth end 152 of the individual extension 114 is formed with a fifth interior screw thread 145.

Each of the plurality of extensions 103 is designed to accommodate smoking material 131 that is the same size as the smoking material 131 the matched individual chamber 113 would accommodate.

In a fourth potential embodiment of the disclosure, the invention 100 as described in the first potential embodiment of the disclosure, the second potential embodiment of the disclosure, and the third potential embodiment of the disclosure further comprises a plurality of tips 104. The plurality of tips 104 comprises a collection of individual tips 115. The purpose of the individual tip 115 is to seal either the tenth end 150 of the individual chamber 113 or the twelfth end 152 of the individual extension 114 to prevent debris from entering the invention 100. Each individual tip 115 is sized to match with an individual chamber 113 and an individual extension 114. The individual tip 115 comprises a tube that is further defined by a thirteenth end 153 and a fourteenth end 154. The individual tip 115 is formed so that the fourteenth end 154 is closed. The thirteenth end 153 of the individual tip 115 is formed with a sixth exterior screw thread 146. The sixth exterior screw thread 146 is sized to fit into the fifth interior screw thread 145. To attach the individual tip 115 to its matched individual chamber 113 the sixth exterior screw thread 146 is screwed into the third interior screw thread 143. To attach the individual tip 115 to its matched individual extension 114, the sixth exterior screw thread 146 is screwed into the fifth interior screw thread 145.

In a fifth potential embodiment of the disclosure, the invention 100 as described in the first potential embodiment of the disclosure, the second potential embodiment of the disclosure, the third potential embodiment of the disclosure and the fourth potential embodiment of the disclosure further comprises a pipe head 117 and a pipe head connection 118. The pipe head connection 118 is further defined with a seventeenth end 157 and an eighteenth end 158. The seventeenth end 157 is fitted with a nineteenth exterior screw thread 159. The nineteenth exterior screw thread 159 of the pipe head connection 118 is designed to match both with the third interior screw thread 143 of a selected an individual chamber 113 selected from the plurality of chambers 102 and with the fifth interior screw thread 145 of a head connection 118 is connected to the pipe head 117. To install the pipe head 117 the nineteenth exterior screw thread 159 is screwed into either the third interior screw head 143 or the fifth interior screw head 145 as desired.

To use the invention 100, the smoking material 131 is prepared by wrapping the smoking material 131 in paper in a shape that roughly approximates a cylinder. An individual chamber 113 is selected from the plurality of chambers 102 and, optionally when desired by the user, an individual extension 114 is selected from the plurality of extensions 103. The individual chamber 113 and the individual extension 114 is selected based on the outer diameter of the prepared smoking materials 131. The invention 100 is then assembled as described above. The prepared smoking material 131 is the inserted into either the tenth end 150 of the individual chamber 113 or the twelfth end 152 of the individual extension 114. The prepared smoking material 131 is then lit and smoked normally.

To use the invention 100 when smoking materials 131 cannot be prepared, the individual chamber 113 that matches the pipe head connection 118 is selected from the plurality of chambers 102 and, optionally when desired by the user, the individual extension 114 that matches the pipe head connection 118 is selected from the plurality of extensions 103. The invention 100 is then assembled as described above. The pipe head 117 is then filled with smoking material 131. The smoking material 131 is then lit and smoked normally.

The mouthpiece 101, each chamber cylinder 108, each extension cylinder 111, each individual tip 115, the chamber plug 122, the pipe head 117 and the pipe head connector 118 can be made of several materials including, metals, plastics, and wood. The material selected for construction is a trade-off between low heat conductivity and low flammability. The screen 106, mesh filter 109, and grip 110 can be made of readily and commercially available materials including, but not limited to, wire mesh, cotton, and rubber sheeting respectively. The use of plastic in the mouthpiece 101 and the chamber plug 122, metal for the chamber cylinder 108, the extension cylinder 111, each individual tip 115, and the pipe head connection 118 is preferred. The use of wood for the pipe head 117 is preferred. The use of rubber sheeting for the grip 110 is preferred.

The following disclosures were used in this disclosure:

Exterior Screw Thread: As used in this disclosure, an exterior screw thread is a ridge wrapped around the outer surface of a tube in the form of a helical structure that used to convert rotational movement into linear movement.

Interior Screw Thread: As used in this disclosure, an interior screw thread is a ridge wrapped around the inner surface of a tube in the form of a helical structure that used to convert rotational movement into linear movement.

Pipe Head: As used in this disclosure, a pipe head is a bowl adapted to contain and burn smoking material wherein the bowl is also adapted to be attached to a tube.

Smoking Material: As used in this disclosure, smoking materials are combustible materials that are intended to be deeply inhaled while they are being burned. This definition is intended to include, but is not limited to, tobacco and tobacco concentrates. This definition is intended to exclude combustible materials that are burned as a perfume but that is generally not purposefully inhaled including, but not limited to, incense and scent oils.

Tube: As used in this disclosure, a tube is a hollow cylindrical device with a first open end and a second open end that is used for transporting liquids and gasses. In this disclosure, the terms inner diameter of a tube and outer diameter are used as they would be used by those skilled in the plumbing arts. The line that connects the center of the first base of the cylinder to the center of the second base of the cylinder is referred to as the axis of the cylinder or the centerline of the tube. When two tubes share the same centerline they are said to be aligned. The face of the tube corresponds to the face of a solid cylinder: the face of the cylinder incorporates what is left of the surface area of the cylinder after the surface area of the faces are excluded.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A cigarette holder comprising:
a mouthpiece and a plurality of chambers;
wherein the mouthpiece is attached to one of the plurality of chambers;
wherein each chamber selected from the plurality of chambers is differentiated from the plurality of chambers by a span of an inner diameter of a chamber cylinder;
wherein the mouthpiece further comprises a mouthpiece cylinder, a screen, and a chamber connection;
wherein the mouthpiece is further defined with a proximal end and an distal end;
wherein the mouthpiece is formed in the shape of a tube;
wherein the chamber connection attaches the mouthpiece to a chamber selected from the plurality of chambers;
wherein the chamber connection further comprises a ratchet rim;
wherein the ratchet rim is a ridge that is formed inside the distal end of the mouthpiece;
wherein the ratchet rim forms a catch surface that runs perpendicular to a centerline of the mouthpiece;
wherein the chamber connection further comprises a chamber plug;
wherein the chamber plug is a tube;
wherein the chamber plug is further defined with a proximal end and a distal end;
wherein the chamber plug further comprises a plurality of latch hooks and a plurality of compression channels;
wherein each individual latch hook is an angled surface that is formed on the proximal end of the chamber plug;
wherein each individual compression channel is a channel formed through a face of the chamber plug; and
wherein each individual latch hook is caught on the catch surface.

2. The cigarette holder according to claim 1 wherein
the plurality of chambers comprises a collection of individual chambers;
wherein each individual chamber further comprises a grip; and
wherein each chamber cylinder is further defined with a proximal end and a distal end.

3. The cigarette holder according to claim 2 wherein the grip is a layer of heat resistant material that is applied to a portion of the face of the chamber cylinder.

4. The cigarette holder according to claim 3 wherein the each individual chamber selected from the plurality of chambers further comprises a mesh filter.

5. The cigarette holder according to claim 4 wherein an interior screw thread is formed inside the distal end of the chamber cylinder; a secondary screen and a secondary mesh filter are provided at the distal end as well as the proximal end of the chamber cylinder; wherein the mesh filter is sandwiched between the secondary screen and the secondary mesh filter that are provided at the distal end as well as the proximal end of the chamber cylinder.

6. The cigarette holder according to claim 5 wherein
the cigarette holder further comprises a plurality of extensions;
wherein the plurality of extensions further comprises a collection of individual extensions;
wherein each individual extension is further defined with an proximal end and a distal end;
wherein the proximal end of each individual extension is fitted with an exterior screw thread;
wherein the distal end of the individual extension is formed with an interior screw thread; and
wherein the exterior screw thread is sized to be received by the interior screw thread.

7. The cigarette holder according to claim 6 wherein
the cigarette holder further comprises a plurality of tips;
wherein the plurality of tips further comprises a collection of individual tips;
wherein each individual tip is further defined by a proximal end and a distal end;
wherein each individual tip is formed so that the distal end is closed;
wherein the proximal end of each individual tip is formed with an exterior screw thread;
wherein the exterior screw thread is sized is sized to be received by the interior screw thread of the individual extension.

8. The cigarette holder according to claim 7 wherein
the cigarette holder further comprises a pipe head and a pipe head connection;
wherein the pipe head connection is further defined with a proximal end and an distal end;
wherein the distal end is fitted with an exterior screw thread;
wherein the exterior screw thread is sized to be received by is sized to be received by the interior screw thread of the chamber cylinder;
wherein the exterior screw thread be received by is sized to the interior screw thread of the individual extension;
wherein the distal end of the head connection is connected to the pipe head.

9. The cigarette holder according to claim 1 wherein
the mouthpiece further comprises an interior screw thread;
wherein the interior screw thread is formed inside the distal end of the mouthpiece;
wherein the interior screw thread is sized to receive an exterior screw thread;
wherein the exterior screw thread is formed on the proximal end of the chamber cylinder;
wherein the second exterior screw thread is sized to be received by the first interior screw thread.

10. The cigarette holder according to claim 9 wherein
the plurality of chambers comprises a collection of individual chambers;
wherein each individual chamber further comprises a grip; and
wherein each chamber cylinder is further defined with a proximal end and a distal end.

11. The cigarette holder according to claim 10 wherein the grip is a layer of heat resistant material that is applied to a portion of the face of the chamber cylinder.

12. The cigarette holder according to claim 11 wherein the each individual chamber selected from the plurality of chambers further comprises a mesh filter.

13. The cigarette holder according to claim 12 wherein an interior screw thread is formed inside the distal end of the chamber cylinder.

14. The cigarette holder according to claim 13 wherein
the cigarette holder further comprises a plurality of extensions;
wherein the plurality of extensions further comprises a collection of individual extensions;
wherein each individual extension is further defined with an proximal end and a distal end;
wherein the proximal end of each individual extension is fitted with an exterior screw thread;

wherein the distal end of the individual extension is formed with an interior screw thread;

wherein the exterior screw thread is sized to be received by the interior screw thread of the chamber cylinder.

15. The cigarette holder according to claim 14 wherein the cigarette holder further comprises a plurality of tips;

wherein the plurality of tips further comprises a collection of individual tips;

wherein each individual tip is further defined by a proximal end and a distal end;

wherein each individual tip is formed so that the distal end is closed;

wherein the proximal end of each individual tip is formed with an exterior screw thread;

wherein the exterior screw thread is sized is sized to be received by the interior screw thread of the individual extension.

16. The cigarette holder according to claim 15 wherein the cigarette holder further comprises a pipe head and a pipe head connection;

wherein the pipe head connection is further defined with a proximal end and an distal end;

wherein the distal end is fitted with an exterior screw thread;

wherein the exterior screw thread is sized to be received by is sized to be received by the interior screw thread of the chamber cylinder;

wherein the exterior screw thread be received by is sized to the interior screw thread of the individual extension;

wherein the distal end of the head connection is connected to the pipe head.

17. The cigarette holder according to claim 16 wherein the proximal end of the chamber cylinder includes external threading that correspond with the first interior screw thread of the distal end of the mouthpiece; wherein each individual latch hook is further defined as external threading that correspond with the interior screw thread of the distal end of the mouthpiece such that the chamber plug threads into the mouthpiece before the chamber cylinder is screwed onto the mouthpiece.

* * * * *